US006883190B2

(12) United States Patent
Carbonneau et al.

(10) Patent No.: US 6,883,190 B2
(45) Date of Patent: Apr. 26, 2005

(54) PATIENT LIFTING SLING

(75) Inventors: Margaret A. Carbonneau, Barrhead (CA); Petrona M. Skoye, Wabamun (CA)

(73) Assignee: Margaret Carbonneau, Edmonton (CA)

( * ) Notice: Subject to any disclaimer, the term of this patent is extended or adjusted under 35 U.S.C. 154(b) by 308 days.

(21) Appl. No.: 10/122,652

(22) Filed: Apr. 15, 2002

(65) Prior Publication Data

US 2003/0192118 A1 Oct. 16, 2003

(51) Int. Cl.[7] ..... A61G 7/10
(52) U.S. Cl. ..... 5/89.1; 5/89.1
(58) Field of Search ..... 5/89.1, 81.1 R, 5/86.1; 294/140

(56) References Cited

U.S. PATENT DOCUMENTS

| | | | | | |
|---|---|---|---|---|---|
| 3,701,395 | A | * | 10/1972 | Theobald | 5/89.1 |
| 5,396,670 | A | * | 3/1995 | Firebaugh et al. | 5/89.1 |
| 6,289,534 | B1 | * | 9/2001 | Hakamiun et al. | 5/89.1 |

FOREIGN PATENT DOCUMENTS

| | | | | |
|---|---|---|---|---|
| CA | 1046202 | * | 1/1979 | 5/89.1 |
| WO | WO 94/15569 | * | 7/1994 | 5/89.1 |

* cited by examiner

*Primary Examiner*—Alexander Grosz

(57) ABSTRACT

A flexible fabric patient supporting sling adapted to be manipulated from a planar condition to a patient supporting condition, in which a seated patient is suspended by four straps from supporting points on a patient lifting device. The fabric sling includes bands adapted to support, the thighs of a suspended patient, and arms with curved straps that cross the chest of the suspended patient.

1 Claim, 2 Drawing Sheets

PATIENT LIFTING SLING

BACKGROUND OF THE INVENTION

Working conditions are often problematic when nursing disabled patients. Lifting the patient is ergonomically difficult for the personnel. They are at risk for back injuries. Today, there are many kinds of auxiliary equipment available for transferring and lifting patients. Various lifting devices, for example mobile lifting devices on legs, bathroom lifters, hoists in the ceiling, etc. are commonly used. When the patient is dressed in a lifting vest, a one-piece garment or a sling, they are secured to a lifting device usually by means of straps. Thus, the patient is carried by the lifting sling and can be transferred to and from a wheelchair by means of the lifting device.

WO9415569 discloses a garment to be worn continuously, covering the body and upper legs. One drawback of prior art continuous wear garment is that the patient would have to wear it continuously during their waking hours. This would make it difficult to provide basic nursing care; personal hygiene care as well as treatments etc. Another drawback is patients with debilitating diseases such as arthritis and contractures would have difficulty putting on such a garment. Lastly, patients would have to have their own garment and this would not be cost effective for most facilities.

The lifting slings on the market at present e.g. (patent #CA 1288 379, U.K. 22234 77 A,U.K. 2184706 A, U.S. Pat. No. 2,920,480, U.S. Pat. No. 1,961,119, U.S. Pat. No. 2,688,410, U.S. Pat. No. 2,739,783, U.S. Pat. No. 2,792,052, U.S. Pat. No. 2,835,902, U.S. Pat. No. 3,222,029, U.S. Pat. No. 3,310,816, U.S. Pat. No. 3,699,594, U.S. Pat. No. 3,962,737, U.S. Pat. No. 3,998,284, U.S. Pat. No. 4,070,721, U.S. Pat. No. 4,232,412, U.S. Pat. No. 4,633,538, U.S. Pat. No. 4,712,257, U.S. Pat. No. 5,022,106, U.S. Pat. No. 5,396,670) usually have a four-point securing system for the supporting straps of the lifting device. Two of them in the shoulder region and two in the thigh region of the patient. Staff are very anxious and patients are very insecure and fearful when using these hammock style slings. The patients are too free to move side-to-side or fall forward, putting them at risk for injury. These hammock styled slings, cause the patient's body to be raised in a slouched position making it difficult for positioning into a wheelchair or onto a commode, causing discomfort to the patient by being positioned inappropriately. Staff members have difficulty and can cause strain on their backs in the process of trying to reposition the patient. The toilet sling which lifts under the arms and legs give no support on the lower back. The gravity of the patient's body weight pulls down on the sling that fits under the arms forcing the arms to raise unnaturally, possibly causing injury to the shoulder in the form of dislocation, fracture or are at risk of falling through.

DETAILED DESCRIPTION OF THE DRAWINGS

Figure 1:
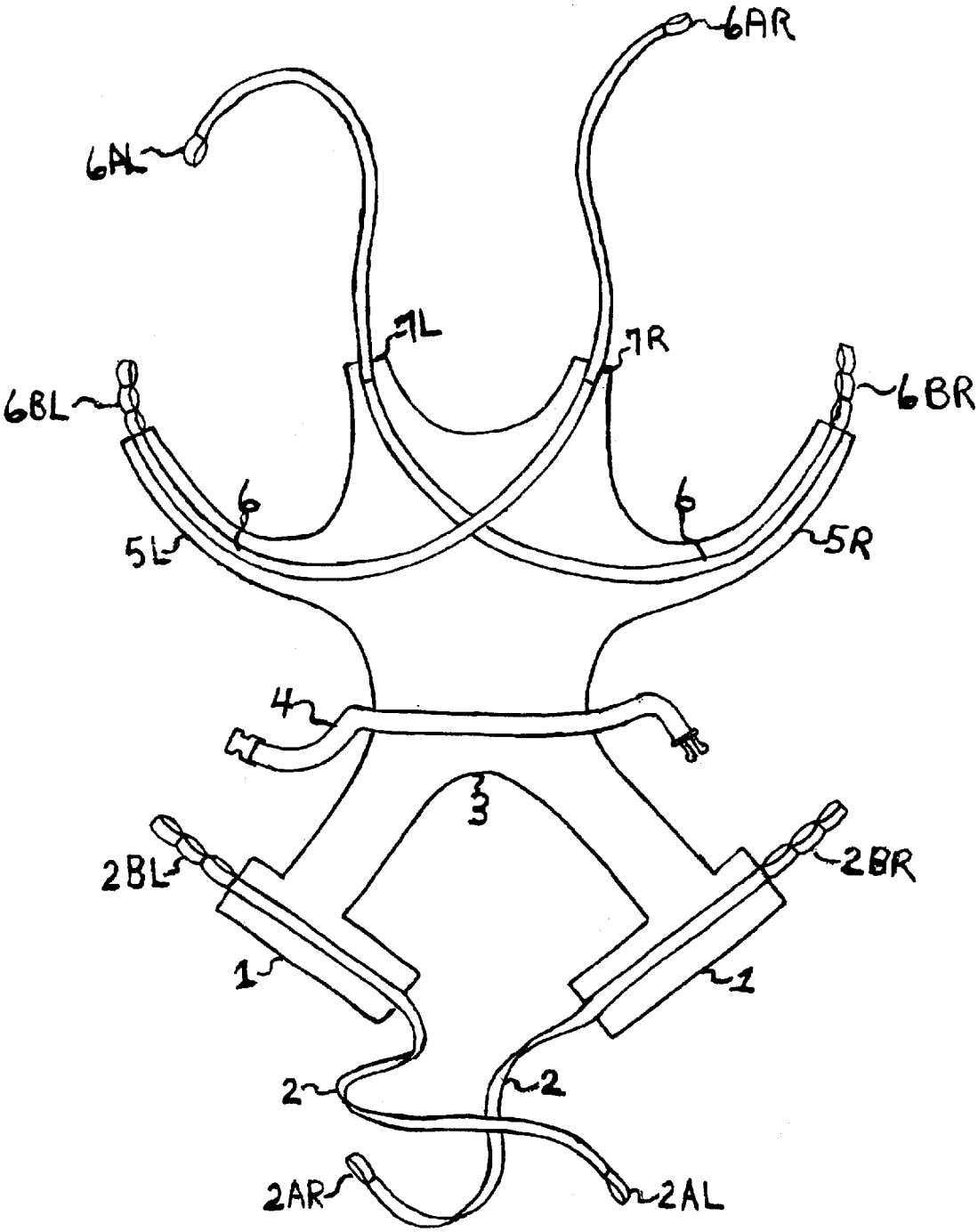
FIG. 1 is a view of the sling device, laid out in a planar, flat condition.
Figure 2:
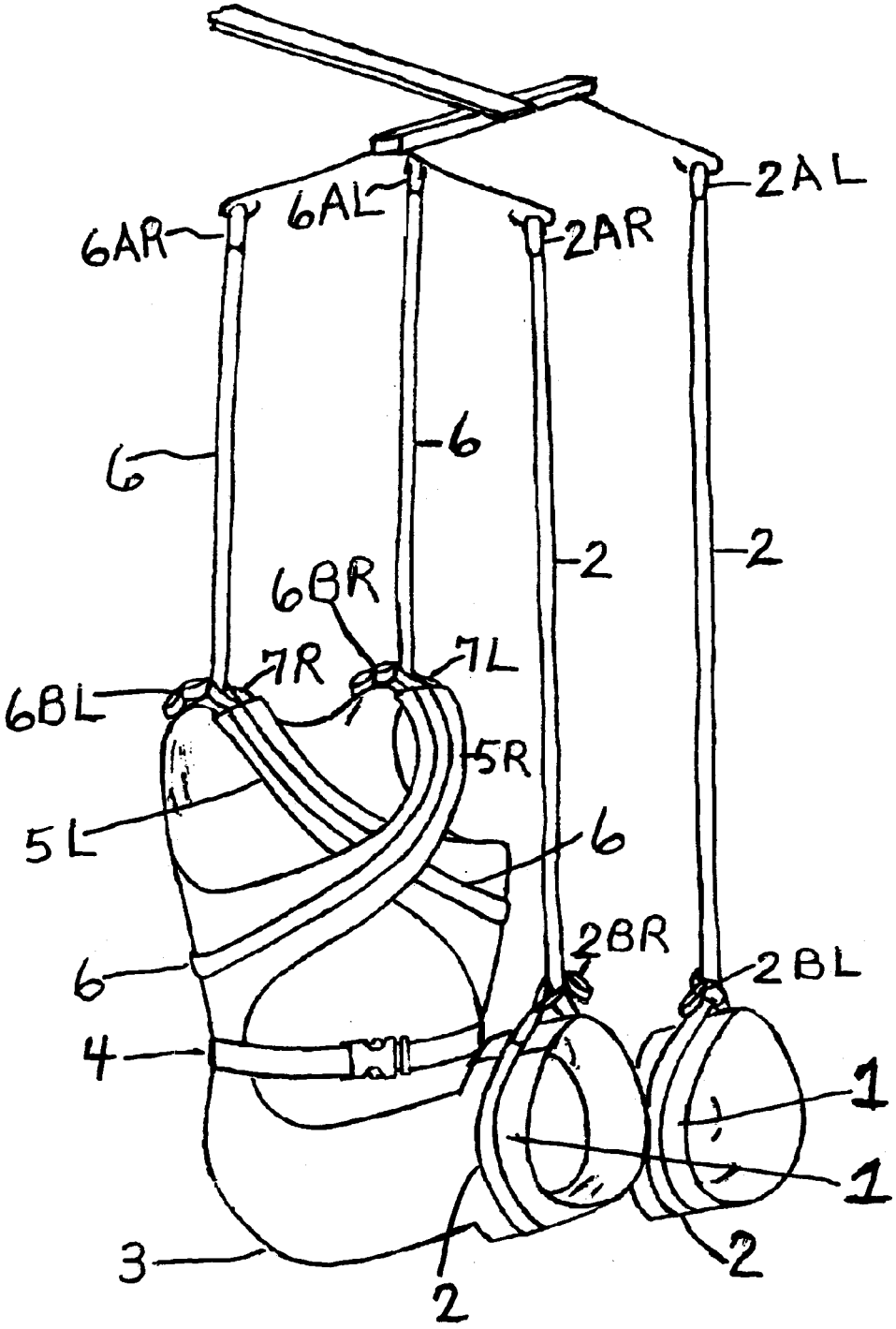
FIG. 2 is a perspective view of the sling device in a use position, while supporting the body of a seated patient (not shown).

The patient lifting sling is comprised of a washable, durable one piece, flexible fabric body of the shape shown in FIG. 1, and a plurality of straps attached to the fabric body as seen in FIG. 1. A first strap 4 is attached to a central portion of the fabric body, across a horizontal line, dividing the sling into an upper and a lower portion. The strap 4 extends beyond the fabric body on both the left and right sides thereof, and terminates in connecting buckles. The strap 4 defines an adjustable waist seat belt that in use, as shown in FIG. 2, helps prevent forward or side-to-side movement of a patient.

The lower portion of the fabric body includes a curved cut out portion 3 bounded by a left and a right leg portion. The left and right leg portions terminate in rectangular left and right bands 1. A strap 2 is attached to each band 1. The strap 2 attached to left band 1 has a first end terminating in a single loop 2AL, and a second end terminating in a plurality of loops 2BL. The strap 2 attached to the right band 1, has a first end terminating in a single loop 2AR and a second end terminating in a plurality of loops 2BR. In use, as seen in FIG. 2, the first ends of the straps 2 are looped and pulled through one of the plurality of loops of the respective second ends of the straps 2, thereby causing bands 1 to surround and support the thighs of a patient. The second ends of straps 2 are removably attached to hooklike support portions of a lifting device, as best seen in FIG. 2.

The upper portion of the fabric body comprises outwardly curved left and right arm portion 5L and 5R, and left and right upper ends 7L and 7R which are separated from each other by a curved cutout portion. The end of left arm 5L is separated from left upper end 7L by a left cutout portion, and the end of right arm 5R is separated from right upper end 7R by a right cutout portion which is of the same size and shape as the left cutout portion.

A left curved strap 6 is attached to the upper body portion and left arm 5L. The left curved strap 6 has a second end terminating in a plurality of loops 6BL, adjacent the outer end of left arm 5L, it exits the upper portion of the fabric body adjacent upper right end 7R, and terminates at its first end in a single loop 6AR.

A right curved strap 6 is attached to the upper body portion and right arm 5R. The right curved strap 6, has a second end terminating in a plurality of loops 6BR, adjacent the outer end of right arm 5R, it exits the upper portion of the fabric body adjacent upper left end 7L, and terminates at its first end in a single loop 6AL.

In use, the single loop 6AR and the first end of left strap 6 are looped and pulled through one of the plurality of loops 6BL, thereby causing the left arm 5L to be positioned across the chest of a patient. The loop 6AR is now ready to be removably attached to a hooklike support of a lifting device, as best seen in FIG. 2. Similarly, the single loop 6AL and the first end of right strap 6 are looped and pulled through one of the plurality of loops 6BR, thereby causing the right arm 5R to be positioned across the chest of a patient. The loop 6AL is now ready to be removably attached to a hooklike support of a lifting device, as best seen in FIG. 2.

The use of a plurality of loops 2BL, 2BR, 6BL and 6BR, with there loops shown in FIG. 1, permits adjustability in the size of sling device, when a patient is positioned therein. Thus the same sling could be used with patients of different size.

The above described sling device provides a comfortable means to lift and transfer a patient. The sling is used to lift a patient in a secure, upright sitting position, permitting the placing of the patient in a wheelchair or commode with minimized discomfort to the patient and minimized strain on assistants handling the patient. When a patient is positioned in a lifted sitting position, as seen in FIG. 2, four lifting points are defined by loops 6AR, 6AL, 2AR and 2AL, with 6AR and 6AL above the shoulders of a patient and with 2AR and 2AL above the thigh of the patient. The waist seat belt strap 4 provides further support and security to the seated patient. As discussed above, the straps 2 and 6 terminate at their first ends in loops 2AL, 2AR, 6AL, 6AR which as seen in FIG. 2 are removably attachable to the hooklike supporting portions of a conventional patient lifting device.

We claim:

1. A patient lifting sling adapted to support a patient in a sitting position, suspended at four points by a patient lifting device, the sling comprising a flexible fabric body adapted to be laid out in a planar flat condition, the fabric body including a centrally located waist seat belt, the seat belt dividing the fabric body in an upper and a lower portion, the lower portion comprised of a left leg portion terminating in a left thigh supporting band that includes a strap terminating in a single loop at its first end and a plurality of loops at its second end, and a right leg portion terminating in a right thigh supporting band that includes a strap terminating in a single loop at its first end, and a plurality of loops at its second end; the upper portion of the fabric body comprised of a left arm that includes a curved strap terminating in a single loop at its first end, and a plurality of loops at its second end; and a right arm that includes a curved strap terminating in a single loop at its first end and a plurality of loops at its second end; the loops at the first ends of the straps adapted to be looped and pulled through one of the pluralities of second loops, and thereafter be removably attached to strap supporting portions of a patient lifting device.

* * * * *